US007056181B2

(12) United States Patent
Beckers

(10) Patent No.: US 7,056,181 B2
(45) Date of Patent: Jun. 6, 2006

(54) METHOD OF MANUFACTURING A LAMP

(75) Inventor: Lucas Beckers, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 3 days.

(21) Appl. No.: 10/636,573

(22) Filed: Aug. 8, 2003

(65) Prior Publication Data

US 2004/0027074 A1 Feb. 12, 2004

Related U.S. Application Data

(62) Division of application No. 10/441,831, filed on Oct. 25, 2001, now Pat. No. 6,740,285.

(30) Foreign Application Priority Data

Nov. 1, 2000 (EP) ..... 00203807

(51) Int. Cl.
*H01J 9/24* (2006.01)

(52) U.S. Cl. ..... 445/72; 445/69; 425/449; 65/374.13

(58) Field of Classification Search ..... 313/573, 313/636, 634, 493, 317; 445/26, 69, 72; 264/637, 651, 86; 425/84, 85, 449; 65/374.13
See application file for complete search history.

(56) References Cited

U.S. PATENT DOCUMENTS 4,418,027 A * 11/1983 Massoud ..... 204/483
4,789,140 A * 12/1988 Lirones ..... 266/238
4,884,959 A 12/1989 Ito et al.
4,999,145 A 3/1991 Thibodeau
5,151,275 A 9/1992 Ito et al.
5,494,432 A * 2/1996 Coggins et al. ..... 425/546
5,700,409 A 12/1997 Corry
6,190,151 B1 * 2/2001 Hunt ..... 425/80.1

FOREIGN PATENT DOCUMENTS

| | | | |
|---|---|---|---|
| DE | 2 315 875 | | 10/1974 |
| DE | 33 15 092 | | 10/1983 |
| EP | 0 926 106 | | 6/1999 |
| EP | 1 001 452 | A1 * | 5/2000 |
| JP | 04371802 | A * | 12/1992 |
| WO | WO9962103 | A * | 12/1999 |

OTHER PUBLICATIONS

Patent Abstracts of Japan, Publication No. 59-184450, Oct. 19, 1984, "Light-Transmitting Alumina Tube", to Toshiba Ceramics Co., Ltd.
Patent Abstracts of Japan, Publication No. 10-188893, Jul. 21, 1998, "Ceramic High Pressure Mercury Discharge Lamp For Liquid Crystal Back Light", to Ushio Inc.

(Continued)

*Primary Examiner*—Ashok Patel

(57) ABSTRACT

A discharge lamp has a discharge vessel enclosing a discharge space. The discharge vessel is provided with a ceramic wall which is formed through sintering of a body shaped by sludge molding. The sludge molding process uses the steps of: injecting an outer porous mold with sludge, precipitating the sludge against the outer mold, removing the excess sludge, removing the outer mold, and pre-firing of the molded body. The sludge is injected into the outer mold by means of hollow needles which extend into the hollow mold.

9 Claims, 2 Drawing Sheets

OTHER PUBLICATIONS

Patent Abstracts of Japan, Publication No. 02-214605, Aug. 27,1990, "Casting Method And Core For Casting", to Ishikawajima Harima Heavy Ind. Co., Ltd.

Patent Abstracts of Japan, Publication No. 01-269505, Oct. 27, 1989, "Cast Molding Method For Closed-End Molded Product And Molding Cast Mold", to Iwao Jiki Kogyo KK.

* cited by examiner

METHOD OF MANUFACTURING A LAMP

This application is a Divisional Application of U.S. patent application Ser. No. 10/144,831, filed Oct. 25, 2001 now U.S. Pat. No. 6,740,285, the entire contents of which are incorporated herewith.

BACKGROUND OF THE INVENTION

The invention relates to a method and apparatus for manufacturing a discharge lamp provided with a discharge vessel which encloses a discharge space with a ceramic wall, said discharge vessel being obtained through sintering of a body formed in a sludge molding process, which sludge molding process comprises injecting a porous outer mold with sludge, deposition of sludge particles against the injected outer mold, removing excess sludge, removing the outer mold, and pre-firing of the molded body.

The invention also relates to a lamp provided with a discharge vessel with a ceramic wall.

This type of method is known from EP 0926106. The sludge is a liquid suspension of sludge particles in a suspension liquid. Water is generally used as the suspension liquid. A sludge molding process is understood to involve, in the context of the present description and claims, a process in which a closed space surrounded by the porous outer mold is filled with sludge, the sludge particles are deposited against the mold wall owing to a removal of suspension liquid, and the remaining, still liquid sludge is decanted. The removal of suspension liquid may take place here both by means of capillary absorption of the suspension liquid by the outer mold and by means of a forced escape of suspension liquid through an applied pressure difference between the enclosed space and the surroundings of the outer mold.

The method allows the formation of a discharge vessel in which a portion designed for enclosing a discharge space and portions designed for accommodating electrical lead-through members are formed as one integral whole. The risk of a sintering seam, which forms the connection between different portions of the discharge vessel, becoming leaky is eliminated thereby.

In practical lamps, the discharge vessel is provided with a discharge space portion which is enclosed by the ceramic wall and has projecting closures at mutually opposed ends, which closures are formed as elongate tubular plugs each with a free end through which the electrical lead-through member is passed to an electrode positioned in the discharge space. Each plug is closed at its free end by means of a suitable melting glass or melting ceramic. The melting glass or melting ceramic also provides an adhesion between the plug and the associated lead-through element.

A disadvantage of the known method is that it leads to the formation of practical lamps with a comparatively great external diameter of the plugs. This may give rise to an undesirable heat balance of the manufactured lamp. A further disadvantage is that an after-treatment of the plug is often found to be necessary for realizing a suitable lead-through opening. The after-treatment consists, for example, in reaming of the plug of the molded discharge vessel, possibly followed by a polishing treatment. After-treatments are disadvantageous because they make the lamp manufacturing process more complicated and also because they increase the risk of production wastage.

SUMMARY OF THE INVENTION

The invention has for its object to provide a means whereby the disadvantages mentioned above are effectively counteracted.

According to the invention, a method of the kind mentioned in the opening paragraph is for this purpose characterized in that the sludge is injected into the outer mold by means of a hollow needle which extends to inside the outer mold. The use of a hollow needle as an injection element extending to inside the hollow mold during injection has the advantage that it acts as an inner mold at the same time. An internal surface portion of the object to be formed, i.e. the discharge vessel to be formed, is defined in a very simple and also very reliable manner through a suitable choice of the external diameter of the hollow needle. It was surprisingly found by the inventors that a projecting plug created in this way and designed to act as a lead-through portion of the discharge vessel does not require any after-treatment after sintering. A further advantage is that in this way the wall thickness of the lead-through portion is found to be well controllable, with the result that the choice of dimensions of the lead-through portion can be largely independent of the choice of dimensions of the discharge space portion of the discharge vessel. Thus, in an advantageous embodiment of the lamp obtained by the method, the discharge space portion of the discharge vessel has a wall thickness D and the lead-through portion has a wall thickness d complying with the relation: $d/D \leqq 1.3$. Preferably, the requirement is also met that the lead-through portion has an external diameter du and the discharge portion a greatest external diameter DU complying with the relation: $du < 1.5\sqrt{DU}$, and for a lamp with a power rating of at most 150 W preferably $du < \sqrt{DU}$.

Preferably, the outer mold has a longitudinal axis, and a hollow needle with a needle axis is present at both ends of the mold, said needle axis coinciding with said longitudinal axis, and the sludge is injected trough said needle in the method according to the invention. The use of this method is highly suitable for the manufacture of a discharge vessel with two diametrically opposed electrodes which are each connected to a lead-through member.

The invention can be used to particular advantage if a discharge vessel provided with a projecting plug is manufactured by the method. It is thus possible in a reliable but simple manner to form a projecting plug which is integral with the rest of the discharge vessel and whose dimensions comply with strict dimensional requirements. Preferably, the hollow needle extends inside the outer mold over at least the length of the projecting plug to be formed. It may be advantageous in this respect that the length over which the hollow needle extends inside the outer mold is substantially equal to the length of the projecting plug plus the wall thickness of the discharge vessel at the area of the discharge space.

$CaSO_4$ (plaster of Paris) is a very suitable mold material which shows a very favorable unmolding behavior. The use of plaster of Paris may lead to some contamination of the molded body with Ca. This may influence the crystal structure of the sintered body under certain circumstances. If such an influence is undesirable, it is preferable for the outer mold to be formed from a material akin to that of the sludge particles at least at its surface against which the sludge particles are deposited during the formation of the vessel. It can be prevented thereby that contamination of the body formed in the sludge molding process has an undesirable influence on the sintering process. A suitable possibility for this is, for example, that the material of the outer mold is of the same kind as that of the ceramic wall to be formed, such as, for example, $Al_2O_3$. Often a so-called sintering dopant, for example MgO, is added to the sludge mass for obtaining a controlled crystal growth of the body formed by the sludge molding process during subsequent sintering. A suitable material for the outer mold surface is a material akin to the material of the sintering dopant. If the sludge contains MgO, a very suitable material is, for example, $MgCO_3$. The $MgCO_3$ has the favorable property that it has a solubility product in water which is substantially equal to that of $CaSO_4$.

BRIEF DESCRIPTION OF THE DRAWINGS

The above and further aspects of the invention will be explained in more detail below with reference to a drawing, in which.

DETAILED DESCRIPTION OF THE PREFERRED EMBODIMENTS

Figure 1:
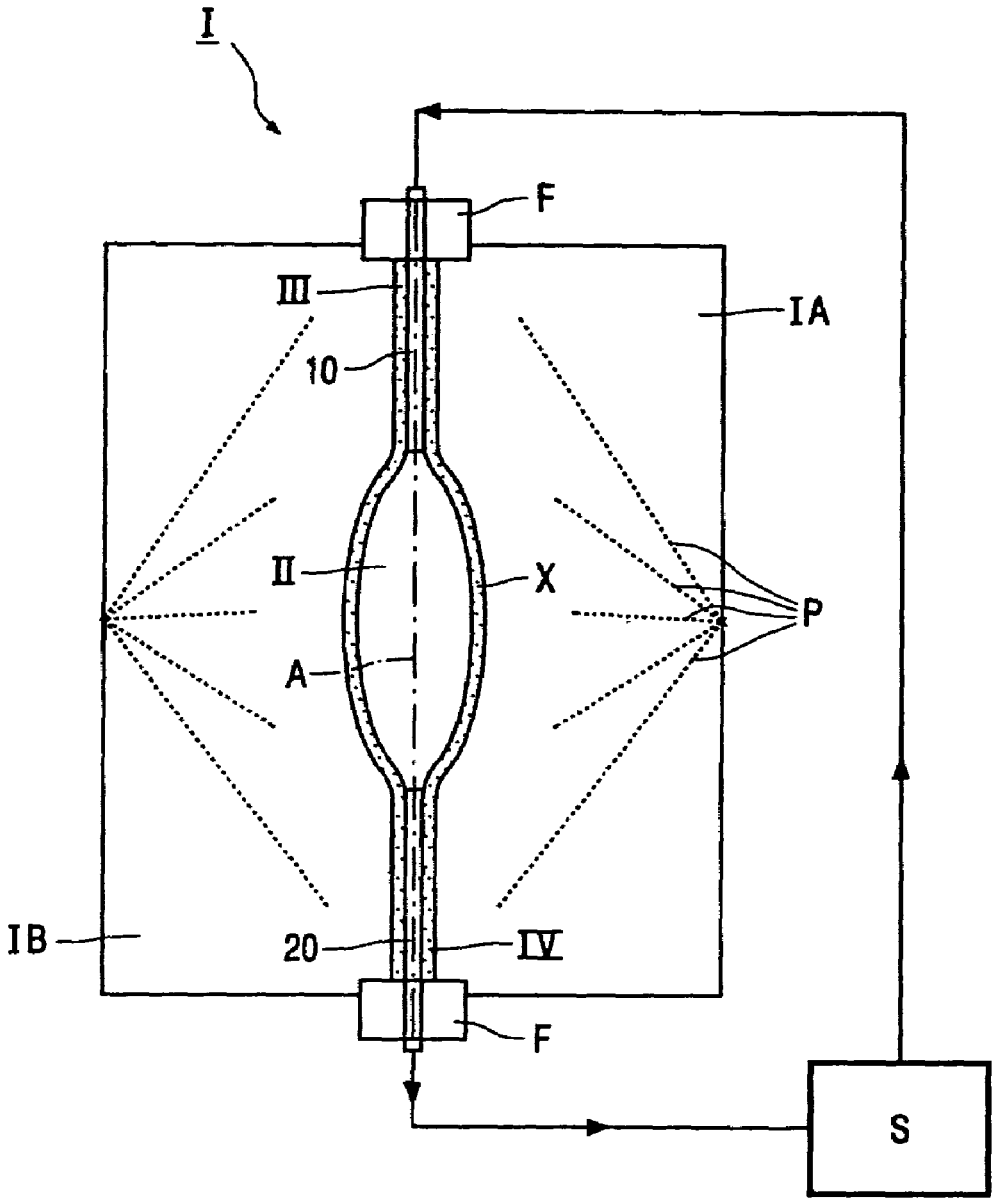
FIG. 1 diagrammatically shows an arrangement for a sludge molding process.

In FIG. 1, I denotes an outer mold comprising two separable parts IA and IB. The outer mold is made of $CaSO_4$ with a porosity of 50% and with pores p with an average dimension of 2 μm. The mutually facing surfaces of the mold parts IA and IB enclose a space II. A channel III, IV is present at either end of the space II, affording access to the space II. Each channel III, IV is closed off at one end by means of a closure F. The space II and the channels III, IV correspond to the circumferential shape of the ceramic body to be formed. The space II has an axis A along which hollow needles 10, 20 extend in the channels III, IV inside the outer mold at either end. Preferably, the needles extend over at least the length of the projecting plug to be formed. It may be advantageous that the length over which a hollow needle extends inside the outer mold is substantially equal to the length of the projecting plug plus the wall thickness of the discharge vessel at the area of the discharge space. The hollow needles 10, 20 extend through the closures F to outside the space II, where they are connected to a sludge reservoir S.

For forming a discharge vessel in accordance with the invention, a sludge molding method is used which comprises the following steps:

injecting a porous outer mold with sludge through one of the channels 10, 20, deposition of sludge particles against the injected outer mold I, and removing excess sludge through the channels 10, 20, removing the outer mold parts IA and IB, and pre-firing of the molded body.

The body thus formed and referenced X is subsequently taken from the mold I, after the needles 10, 20 have been removed, and is sintered into a translucent gas-tight body in a usual manner in a sintering furnace, whereupon a discharge vessel is manufactured with this translucent gas-tight body, again in a usual manner, and a lamp is made therefrom. A certain shrinkage familiar to those skilled in the art will occur during sintering.

A suitable sludge has a composition as indicated below:

| | |
|---|---|
| Alumina powder | 40% by vol. |
| Citric acid | 0.6% by vol. |
| Acryl polymer | 4% by vol. |
| Water | 55.4% by vol. |

Preferably, the deposition of the injected sludge particles takes place through capillary suction of the sludge liquid in the pores p of the outer mold I.

When the described sludge molding method is used, it is possible to choose the dimension of the channel diameter to a high degree independently of the size of the enclosed space II. This renders it possible for the projecting plug of the molded discharge vessel, in the case of a discharge vessel for a discharge lamp with a power rating of at most 150 W, to have an external diameter du which in relation to the greatest external diameter of the discharge vessel DU complies with: $du<\sqrt{DU}$.

In a practical realization of a discharge vessel of a lamp with a very low power rating, for example 20 W, the discharge space portion in the final sintered state has a greatest external diameter DU of 2.08 mm and a wall thickness D of 0.32 mm. The projecting plug has an external diameter du of 1.28 mm and a wall thickness d of 0.44 mm. The relation $du<\sqrt{DU}$ is accordingly complied with. The wall thickness D of the discharge space portion is 0.8 mm and the external diameter DU is 15 mm for a discharge vessel suitable for a lamp with a power rating of 150 W. The external diameter du of the projecting plug in this case is 2.6 mm, so it is true again that $du<\sqrt{DU}$. The projecting plug has a wall thickness of 0.93 mm.

A suitable discharge vessel for a lamp with a power rating of 300 W has a greatest external diameter DU of the discharge space portion of 23 mm with a wall thickness of 2 mm. The external diameter du and the wall thickness of the projecting plug are 4.8 mm and 1.6 mm, respectively. So here it is true that $du<1.5\sqrt{DU}$.

In a further practical realization of a discharge vessel manufactured by the sludge molding method described above, the discharge vessel has a greatest external diameter DU at the area of the discharge space portion of 25 mm and a wall thickness D of 2 mm. The discharge vessel is provided with a projecting plug at either end with an external diameter du of 5 mm and an internal diameter of 1.5 mm. The wall thickness d of the projecting plug accordingly is 1.75 mm and the relation $d/D \leqq 1.3$ is easily complied with. The discharge vessel thus formed is suitable for use in a metal halide lamp with a power rating of 400 W.

Figure 2:
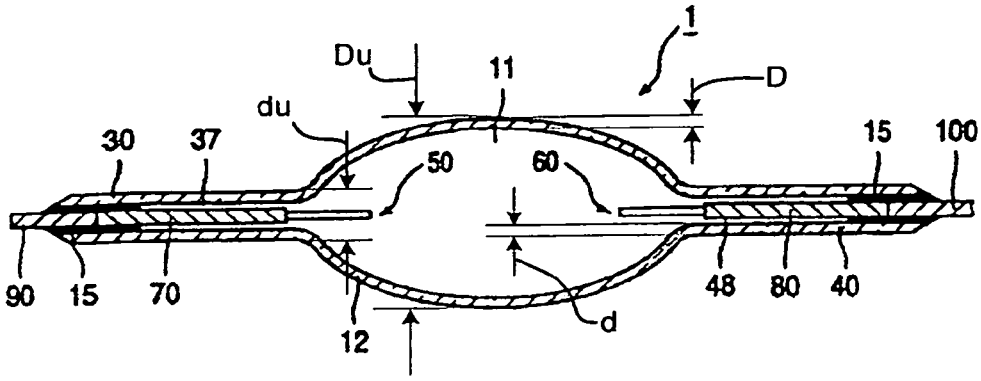
FIG. 2 shows a discharge vessel obtained by means of the sludge molding process.

FIG. 2 shows a discharge vessel 1 (not true to scale) obtained by the method as described above. The discharge vessel encloses a discharge space 11 which contains an ionizable filing. Two electrodes 50, 60 are arranged in the discharge space. The discharge vessel has a ceramic wall 12 and is provided with a ceramic projecting plug 30, 40. The electrode 50, 60 is positioned in the discharge space 11 and is connected to an electric current conductor 90, 100 by means of a lead-through element 70, 80 which is passed through the ceramic projecting plug 30, 40 with narrow fit 37, 48 and is connected thereto in a gas-tight manner by means of a melting glass or melting ceramic joint 15.

Figure 3:
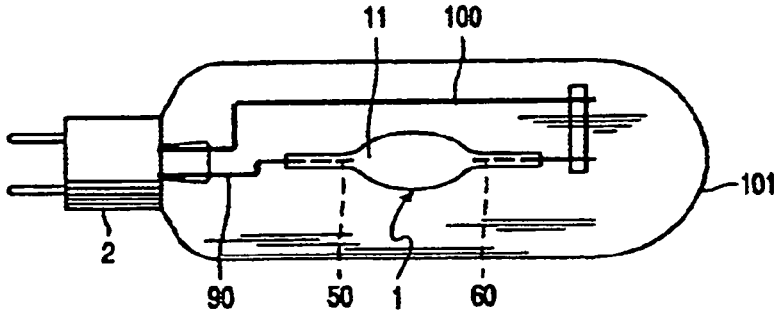
FIG. 3 shows a lamp provided with a discharge vessel of FIG. 2.

FIG. 3 shows a high-pressure discharge lamp provided with the discharge vessel 1 of FIG. 2. The discharge vessel is surrounded by an outer bulb 101 which is fitted at one end with a lamp cap 2. A discharge extends between the electrodes 50, 60 in the operational state of the lamp. The electrode 50 is connected to a first electrical contact forming part of the lamp cap 2 via a current conductor 90. The electrode 60 is connected to a second electrical contact forming part of the lamp cap 2 via a current conductor 100.

The scope of protection of the invention is not limited to the embodiments given by way of example. The invention resides in each novel characteristic and any combination of characteristics. Reference numerals in the claims do not limit the scope of protection thereof. The use of forms of the verb "comprise" does not exclude the possible presence of elements other than those mentioned in the claims. The use of the indefinite article "a" and "an" preceding an element does not exclude the possible presence of a plurality of such elements.

What is claimed is:

1. An apparatus for manufacturing a discharge lamp having a discharge vessel which encloses a discharge space with a ceramic wall, comprising:

a porous outer mold, said porous out mold having pores and channels; and first and second hollow, water based sludge supply needles which extend from outside of the porous outer mold, through the channels and into the interior of the mold from different ends of the mold to inject sludge from a sludge reservoir into the mold, deposit sludge against a wall of the mold, and remove excess sludge from the interior of the mold.

2. An apparatus as claimed in claim 1, wherein the outer mold has a longitudinal axis, and wherein axes of the first and second hollow needles have a predetermined relationship with the longitudinal axis of the outer mold.

3. An apparatus as claimed in claim 2, wherein the predetermined relationship comprises the first and second needles having a predetermined alignment with the longitudinal axis of the outer mold.

4. An apparatus as claimed in claim 1, wherein the outer mold is configured to induce deposition of the sludge through capillary action of the sludge liquid in the pores of the outer mold material.

5. An apparatus as claimed in claim 1, wherein the sludge has a composition comprising alumina powder and citric acid.

6. An apparatus as claimed in claim 1, wherein the sludge comprises a polymer.

7. An apparatus for manufacturing a discharge lamp having a discharge vessel which encloses a discharge space with a ceramic wall, comprising:

a porous outer mold having pores and channels; and first and second hollow needles which extend from outside of the porous outer mold, which are axially aligned, which pass throught the channels and extend into a cavity within the mold from different ends of the mold, and which are configured to inject a water based sludge from a sludge reservoir into the mold, deposit sludge against a wall of the mold, and remove excess sludge from the interior of the mold.

8. An apparatus for manufacturing a discharge lamp having a discharge vessel which encloses a discharge space with a ceramic wall, comprising:

a porous outer mold; and first and second hollow needle means for:

injecting a water based sludge from a sludge reservoir into the mold, depositing sludge against a wall of the mold, and removing excess sludge from the interior of the mold.

9. An apparatus as claimed in claim 1, wherein the porous outer mold comprises a multitude of said pores and a plurality of said channels.

* * * * *